US008827593B1

(12) United States Patent
Oetken

(10) Patent No.: US 8,827,593 B1
(45) Date of Patent: Sep. 9, 2014

(54) MODIFYING COMPACTION EFFORT BASED ON FLUID MASS

(71) Applicant: Caterpillar Paving Products Inc., Brooklyn Park, MN (US)

(72) Inventor: Nicholas A. Oetken, Brooklyn Park, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 0 days.

(21) Appl. No.: 13/930,201

(22) Filed: Jun. 28, 2013

(51) Int. Cl.
*E01C 19/28* (2006.01)

(52) U.S. Cl.
USPC ..... 404/117; 404/75; 404/84.05; 404/122; 404/130

(58) Field of Classification Search
CPC ..... E01C 19/002; E01C 19/22; E01C 19/28; E01C 19/286
USPC ..... 404/75, 84.05, 117, 122, 130
See application file for complete search history.

(56) References Cited

U.S. PATENT DOCUMENTS

| | | | | | |
|---|---|---|---|---|---|
| 3,008,389 | A | * | 11/1961 | Hicks | 404/130 |
| 3,616,730 | A | * | 11/1971 | Boone et al. | 404/117 |
| 3,656,419 | A | * | 4/1972 | Boone | 404/117 |
| 4,149,253 | A | * | 4/1979 | Paar et al. | 701/50 |
| 5,727,900 | A | * | 3/1998 | Sandstrom | 404/84.1 |

* cited by examiner

*Primary Examiner* — Raymond W Addie
(74) *Attorney, Agent, or Firm* — Andrew A. Phillips

(57) ABSTRACT

A vibratory compactor includes a first compacting element having a variable vibratory mechanism that sets a modifiable compaction effort, a second compacting element, a fluid reservoir, a first sensor configured to measure a first data parameter associated with the fluid reservoir, and a control system. The control system is configured to receive the first data parameter, determine a target compaction effort for the first compacting element based on the first data parameter; and modify the variable vibratory mechanism to set the compaction effort at the target compaction effort.

20 Claims, 3 Drawing Sheets

MODIFYING COMPACTION EFFORT BASED ON FLUID MASS

TECHNICAL FIELD

The present disclosure relates generally to automating the compaction process for a vibratory compactor. More particularly, the present disclosure relates to monitoring a data parameter and modifying the compaction effort of a trailing drum of the vibratory compactor based on the data parameter.

BACKGROUND

Compactor machines, also variously called compaction machines, are frequently employed for compacting fresh laid asphalt, dirt, gravel, and other compactable materials associated with road surfaces. For example, during construction of roadways, highways, parking lots and the like, loose asphalt is deposited and spread over the surface to be paved. One or more compactors, which may be self-propelling machines, travel over the surface whereby the weight of the compactor compresses the asphalt to a solidified mass. The rigid, compacted asphalt has the strength to accommodate significant vehicular traffic and, in addition, provides a smooth, contoured surface that may facilitate traffic flow and direct rain and other precipitation from the road surface. Compactors are also utilized to compact soil or recently laid concrete at construction sites and on landscaping projects to produce a densified, rigid foundation on which other structures may be built.

One such type of compaction machine is a drum-type compactor having one or more drums adapted to compact particular material over which the compactor is being driven. In order to compact the material, the drum-type compactor, or vibratory compactor, includes a drum assembly having a variable vibratory mechanism that, for example, includes inner and outer eccentric weights arranged on a rotatable shaft situated within a cavity of the inner eccentric weight. Both amplitude and frequency of vibration (also referred to as compaction effort) are typically controlled to establish the degree of compaction. Amplitude is often controlled by a transversely moveable linear actuator adapted to axially bear against an axially translatable key shaft, causing the key shaft to rotate. The rotation of the key shaft in turn alters relative positions of the inner and the outer eccentric weights to vary amplitude of vibration created within the drum. Frequency of vibration is controlled by changing the speed of a drive motor positioned within the compactor drum. Compaction effort is modified by either modifying the amplitude, frequency, or amplitude and frequency. Typical vibratory compactors have either a single drum with a variable vibratory mechanism or two drums each having a variable vibratory mechanism.

Vibratory compactors typically have fluid tanks or reservoirs coupled to the frame. By way of example, JP03694347 shows a compaction machine with a water tank. These tanks may hold fluids such as water and fuel. Vibratory compactors and, in particular, asphalt compactors contain large water tanks to minimize the amount of bituminous material that sticks to the drums. Additionally, vibratory compactors have a sprung mass or static mass that plays a large role in the compaction effort of the machine. The larger the static mass, the greater the compaction effort may be. The volume of water and fuel on the machine contributes to the static mass of the machine.

SUMMARY OF THE DISCLOSURE

In one aspect, a vibratory compactor includes a first compacting element having a variable vibratory mechanism that sets a modifiable compaction effort, a second compacting element, a fluid reservoir, a first sensor configured to measure a first data parameter associated with the fluid reservoir, and a control system. The control system is configured to receive the first data parameter, determine a target compaction effort for the first compacting element based on the first data parameter; and modify the variable vibratory mechanism to set the compaction effort at the target compaction effort.

In another aspect, a vibratory compactor includes a frame, a first cylindrical drum coupled to the frame and having a modifiable first compaction effort, a second cylindrical drum coupled to the frame and having a modifiable second compaction effort, a fluid reservoir, a sensor measuring a first data parameter, and a control system. The control system is configured to receive the first data parameter, determine a first target compaction effort for the first cylindrical drum based on the first data parameter, determine a second target compaction effort for the second cylindrical drum based on the first data parameter, modify the first compaction effort to the first target compaction effort; and modify the second compaction effort to the second target compaction effort.

In yet another aspect, a method of vibratory compaction includes providing a vibratory compactor assembly that has a first cylindrical drum having a modifiable first compaction effort, a second cylindrical drum, and a fluid reservoir. The method further includes rotating a first cylindrical drum, rotating a second cylindrical drum, determining a mass of a fluid in the fluid reservoir, determining a target compaction effort for the first cylindrical drum based on the mass, and modifying the first compaction effort to the target compaction effort.

DETAILED DESCRIPTION

This disclosure relates generally to a vibratory compactor machine having one or more roller drums that are in rolling contact with a surface to be compacted. A compactor is generally used in situations where loose surface material, characterized as material which can be further packed or densified, is disposed over the surface. As the compactor machine travels over the surface, vibrational forces generated by the compactor machine and imparted to the surface, acting in cooperation with the weight of the machine, compress the loose material to a state of greater compaction and density. The compactor machine may make one or more passes over the surface to provide a desired level of compaction. In one intended application, the loose material may be freshly deposited asphalt that is to be compacted into roadways or similar hardtop surfaces. However, in other applications, the material may be soil, gravel, sand, land fill trash, concrete or the like.

Figure 1:
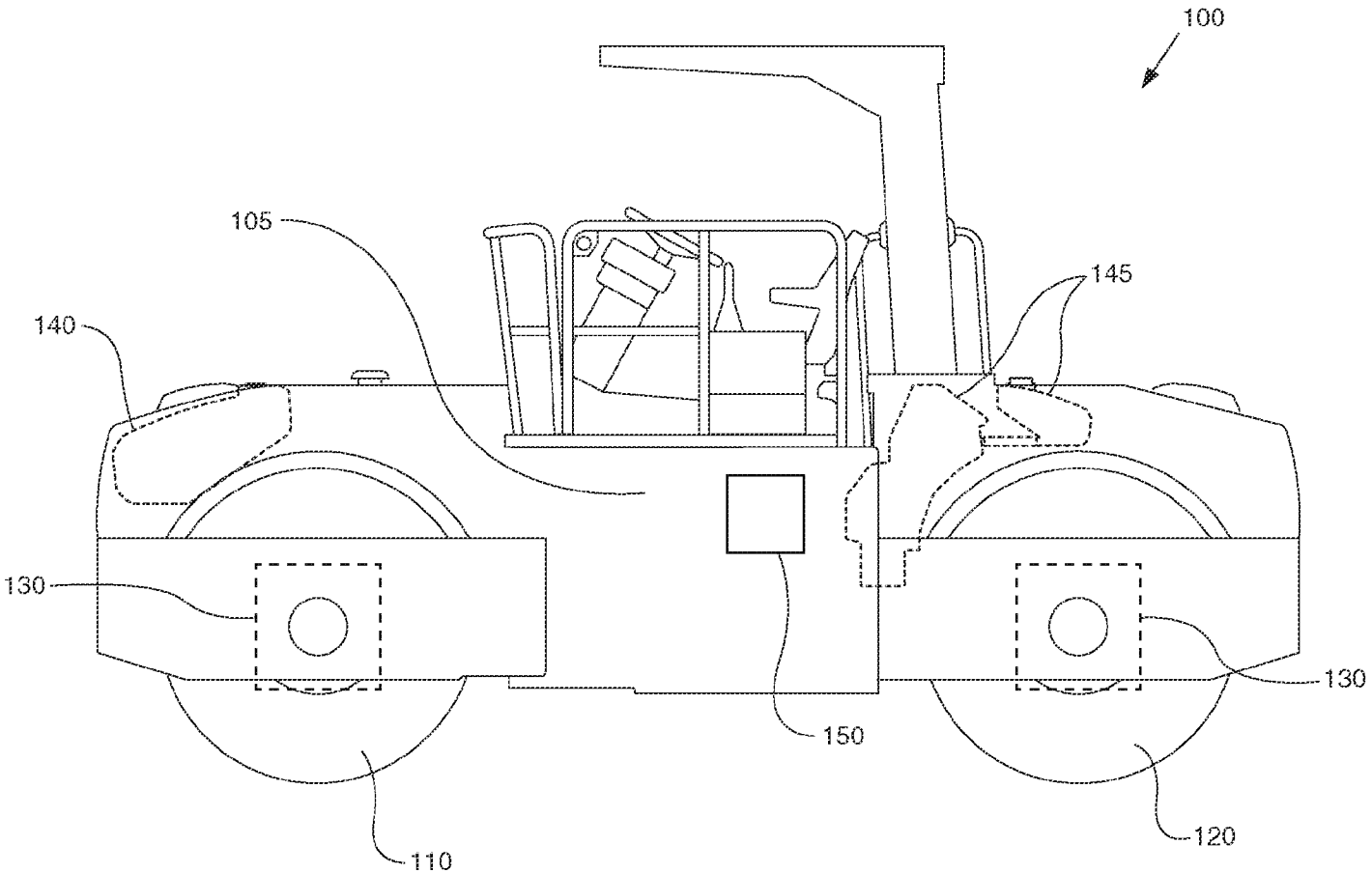
FIG. 1 is a side view of a compactor, according to an exemplary embodiment of the present disclosure.

An exemplary embodiment of a compaction machine 100 is shown generally in FIG. 1. Compaction machine 100, which is shown as a vibratory compactor, may be any machine used to compact a surface material. Compaction machine 100 has a frame 105, a first compacting element 110 (or first cylindrical drum 110), and a second compacting element 120 (or second cylindrical drum 120). Both first compacting element 110 and second compacting element 120 are rotatably coupled to frame 105 so that first and second compacting elements 110, 120 roll over the surface material as compaction machine 100 travels.

It will be appreciated that first compacting element 110 can have the same or different construction as second compacting element 120. In particular, first compacting element 110 is an elongated, hollow cylinder with a cylindrical drum shell that encloses an interior volume. The cylindrical roller drum extends along and defines a cylindrical drum axis. To withstand being in rolling contact with and compacting the surface material, the drum shell can be made from a thick, rigid material such as cast iron or steel. While the illustrated embodiment shows the surface of the drum shell as having a smooth cylindrical shape, in other embodiments, a plurality of bosses or pads may protrude from the surface of the drum shell to, for example, break up aggregations of the material being compacted.

Both first compacting element 110 and second compacting element 120 may have a variable vibratory mechanism 130. While FIG. 1 shows both first and second compacting elements 110, 120 having variable vibratory mechanisms 130, in other embodiments only one of first and second compacting elements 110, 120 may have variable vibratory mechanism 130. In other words, the present disclosure is applicable to compaction machine 100 having (1) first and second compacting elements 110, 120 both having variable vibratory mechanism 130, (2) first compacting element 110 having variable vibratory mechanism 130 and second compacting element 120 not having variable vibratory mechanism 130; and (3) second compacting element 120 having variable vibratory mechanism 130 and first compacting element 110 not having variable vibratory mechanism 130.

Variable vibratory mechanism 130 is disposed inside the interior volume of the roller drum. According to one exemplary embodiment, variable vibratory mechanism 130 includes one or more weights or masses disposed inside the roller drum at a position off-center from the axis line around which the roller drum rotates. As the roller drum rotates, the off-center or eccentric positions of the masses induce oscillatory or vibrational forces to the drum that are imparted to the surface being compacted. The weights are eccentrically positioned with respect to the common axis and are typically movable with respect to each other about the common axis to produce varying degrees of imbalance during rotation of the weights. The amplitude of the vibrations produced by such an arrangement of eccentric rotating weights may be varied by positioning the eccentric weights with respect to each other about their common axis to vary the average distribution of mass (i.e., the centroid) with respect to the axis of rotation of the weights. Vibration amplitude in such a system increases as the centroid moves away from the axis of rotation of the weights and decreases toward zero as the centroid moves toward the axis of rotation. Varying the rotational speed of the weights about their common axis may change the frequency of the vibrations produced by such an arrangement of rotating eccentric weights. In some applications, the eccentrically positioned masses are arranged to rotate inside the roller drum independently of the rotation of the drum. The present disclosure is not limited to these embodiments described above. According to other alternative embodiments, any variable vibratory mechanism 130 that modifies the compaction effort of a first compacting element 110 or a second compacting element 120 may be used.

Variable vibratory mechanism 130 controls the compaction effort for first and second compacting elements 110, 120. By altering the distance of the eccentric weights from the axis of rotation in variable vibratory mechanism 130, the amplitude portion of the compaction effort is modified. By altering the speed of the eccentric weights around the axis of rotation in variable vibratory mechanism 130, the frequency portion of the compaction effort is modified. Additionally, both the amplitude portion and the frequency portion of the compaction effort of variable vibratory mechanism 130 can be modified by changing both the distance of the eccentric weights from the axis of rotation and the speed of rotation of the eccentric weights around the axis of rotation at the same time.

Compaction machine 100 also includes a first fluid reservoir 140 and a second fluid reservoir 145. In one embodiment, first fluid reservoir 140 is used to hold fuel while second fluid reservoir 145 is used to hold water. In other embodiments, first fluid reservoir 140 and second fluid reservoir 145 may hold other fluids or, alternatively, hold the same type of fluid.

Compaction machine 100 also includes a control system 150 that is coupled to a first sensor 160 (see FIG. 2) and a second sensor 170 (see FIG. 3) either through wired or wireless communication methods known in the art. Control system 150 receives a data parameter from first sensor 160 associated with the mass or weight of the fluid in first fluid reservoir 140. Control system 150 also receives a data parameter from second sensor 170 associated with the mass or weight of the fluid in second fluid reservoir 145. In one exemplary embodiment, the data parameter from first sensor 160 is the level of fluid in first fluid reservoir 140 and from second sensor 170 is the level of fluid in second fluid reservoir 145.

Control system 150 is also coupled with variable vibratory mechanisms 130 either through wired or wireless communication methods known in the art. Control system 150 calculates target compaction efforts and modifies the compaction effort of variable vibratory mechanisms 130 in first compacting element 110 and second compacting element 120 to achieve target compaction efforts as described further herein.

Figure 2:
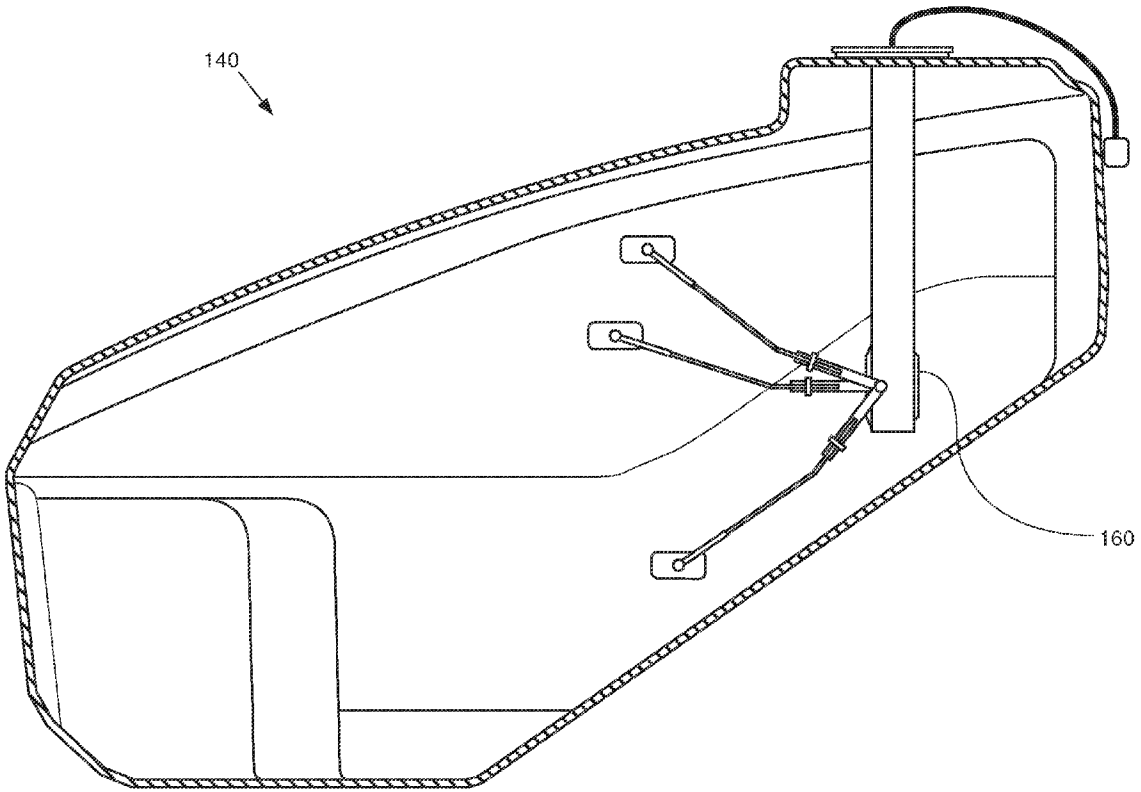
FIG. 2 is a cross-sectional view of a fluid reservoir, according to an exemplary embodiment of the present disclosure.

FIG. 2 shows a cross-sectional view of first fluid reservoir 140 according to an embodiment of the present disclosure. First fluid reservoir 140 has first sensor 160 used to measure the level of the fluid in first fluid reservoir 140. According to one exemplary embodiment, first sensor 160 senses three levels in first fluid tank 140. Those fluid level measurements are then communicated from first sensor 160 to control system 150 to determine the mass of the fluid in first fluid tank 140.

Figure 3:
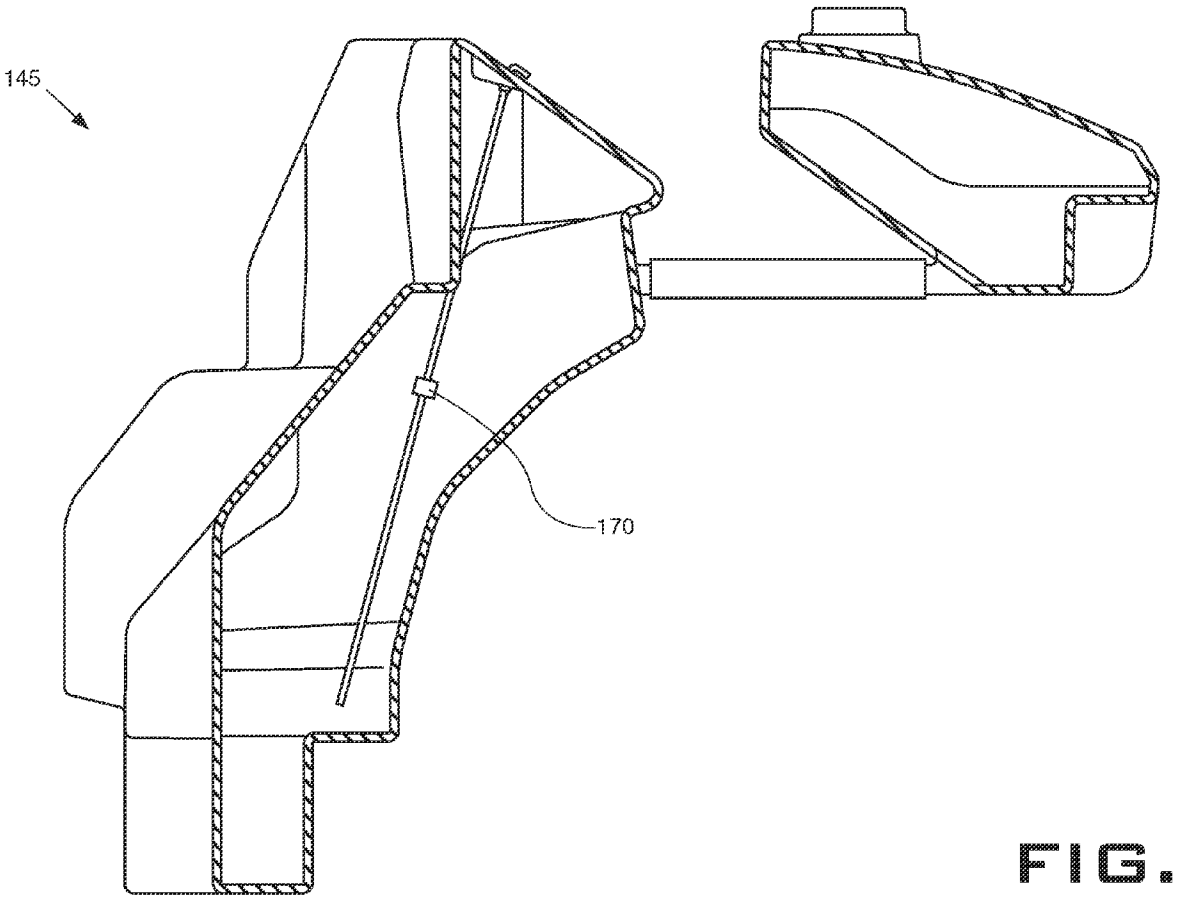
FIG. 3 is a cross-sectional view of a fluid reservoir, according to an exemplary embodiment of the present disclosure.

FIG. 3 shows a cross-sectional view of second fluid reservoir 145 according to an embodiment of the present disclosure. Second fluid reservoir 145 has second sensor 170 used to measure the level of the fluid in second fluid reservoir 145. According to one exemplary embodiment, second sensor 170 uses a float to sense the level of fluid in second fluid reservoir 145. That fluid level measurement is then communicated from second sensor 170 to control system 150 to determine the mass of the fluid in second fluid tank 145.

The present disclosure is not limited to compaction machine 100 having only two fluid tanks. Compaction machine 100 may have only a single fluid tank, or it may contain multiple fluid tanks. Additionally, on compaction machine 100, first fluid tank 140 and second fluid tank 145 need not look like the embodiments shown in FIGS. 2 and 3. The shapes of first fluid tank 140 and second fluid tank 145 are exemplary in nature, and any container for holding fluid is sufficient. Further, first sensor 160 and second sensor 170 are also exemplary in nature, and each fluid container need only have a type of sensing device that provides a signal that can be used to ultimately calculate the weight of the fluid within the container. Such devices are well known in the art, and any will suffice.

INDUSTRIAL APPLICABILITY

The present disclosure finds potential application in any compaction machine 100 that has first compacting element 110 and second compacting element 120, and where at least one of first compacting element 110 and second compacting element 120 has variable vibratory mechanism 130, and where compaction machine has at least one fluid tank (e.g., first fluid tank 140 or second fluid tank 145). In particular, the present disclosure assists in ensuring that compaction machine 100 applies the proper amount of compaction effort on the surface material by determining a target compaction effort based on the mass of the fluid in first fluid tank 140 and second fluid tank 145.

In one embodiment, compacting machine 100 has first compacting element 110 and second compacting element 120. Only second compacting element 120 has variable vibratory mechanism 130. Compacting machine 100 also has first fluid tank 140, which has first sensor 160 measuring the fluid level in first fluid tank 140, and second fluid tank 145, which has second sensor 170 measuring the fluid level in second fluid tank 145. Control system 150 receives the fluid level measurements from sensors 160, 170, determines the mass or weight of the fluids in first fluid tank 140 and second fluid tank 145, and determines a target compaction effort for second compacting element 120. Control system 150 then modifies the compaction effort of second compacting element 120 by altering the output of variable vibratory mechanism 130 to achieve the target compaction effort. This ensures that the proper compaction effort is exerted on the surface material. With the heavier static mass achieved by the addition of the fluid mass into the static mass calculation, compaction machine 100 may exert a higher compaction effort on the surface material, ensuring that a compaction job is done with less compaction machine 100 passes, saving cost for the operators. Additionally, compaction effort can be adjusted as the mass of the fluid goes down as compacting machine 100 uses fluid.

In another embodiment, compacting machine 100 has first compacting element 110 and second compacting element 120. Both first compacting element 110 and second compacting element 120 have variable vibratory mechanisms 130. Compacting machine 100 also has first fluid tank 140, which has first sensor 160 measuring the fluid level in first fluid tank 140, and second fluid tank 145, which has second sensor 170 measuring the fluid level in second fluid tank 145. Control system 150 takes the fluid level measurements from sensors 160, 170, determines the mass or weight of the fluids in first fluid tank 140 and second fluid tank 145, and determines a first target compaction effort for first compacting element 110 and a second target compaction effort for second compacting element 120. Control system 150 then modifies the compaction effort of first compacting element 110 to the first target compaction effort and modifies the compaction effort of second compacting element 120 to the second target compaction effort. This ensures that the proper compaction effort is exerted on the surface material by both first compacting element 110 and second compacting element 120.

In practice, control system 150 determines a target compaction effort for each cylindrical drum or compacting element 110, 120 with variable vibratory mechanism 130. In an embodiment where only one drum has variable vibratory mechanism 130, for example, second compacting element 120, the target compaction effort calculation will take into consideration both masses of fluid in first fluid tank 140 and second fluid tank 145. However, the target compaction effort may give more weight to the mass of fluid in second fluid tank 145, since second fluid tank 145 is located directly over second compacting element 120. Similarly, in an embodiment where both first compacting element 110 and second compacting element 120 have variable vibratory mechanisms 130, the target compaction effort for first compacting element 110 may be more heavily weighted to the mass in first fluid tank 140, which is located directly over first compacting element 110, while the target compaction effort for second compacting element 120 may be more heavily weighted to the mass in second fluid tank 145, which is located directly over second compacting element 120. While it is not necessary for first fluid tank 140 to be directly over first compacting element 110, or second fluid tank 145 to be directly over second compacting element 120, the present disclosure recognizes that target compaction efforts will be biased towards the location of the fluid tank or fluid tanks present on compaction machine 100 based on the location of the tank or tanks on compaction machine 100.

The target compaction effort will also be affected by the type of fluid in first fluid tank 140 and second fluid tank 145. In the embodiment where first fluid reservoir 140 is holding fuel and second fluid reservoir 145 is holding water, control system 150 will take the specific density characteristics of the fluid into account when determining the target compaction effort. In other embodiments, control system 150 will take the specific density characteristics of the specific fluid in the fluid tank or tanks into account when determining the target compaction effort.

In an alternative embodiment, the target compaction effort for second compacting element 120 may be based on either the mass of first fluid tank 140, second fluid tank 145, or first fluid tank 140 and second fluid tank 145. In other words, control system 150 may calculate three target compaction efforts, and then modifies the target compaction effort based on only one of the three target compaction efforts. In an embodiment with first compacting element 110 and second compacting element 120 both having variable vibratory mechanisms 130, an operator may only want the compaction effort of one of either first compacting element 110 or second compacting element 120 modified. It is also important to note that there are instances in which an operator may choose not to initiate this routine at all, or control system 150 may not run the routine.

Using the fluid mass of first fluid tank 140 and second fluid tank 145 to determine the target compaction effort for variable vibratory mechanism or mechanisms 130 helps to achieve a better compaction effort by compaction machine 100 based on a more accurate calculation of the static mass of compaction machine 100. This generally allows a higher compaction effort by compaction machine 100 and minimizes the need for multiple passes. The present disclosure thereby assists in further automating the compaction process and the overall paving process, and leads to reduced labor costs and helping the operators reduce potentially costly errors in the compaction and paving processes.

While the present disclosure describes the fluid mass as determining the compaction effort of first compacting element 110 and second compacting element 120, in operation, the fluid mass is not the only factor used to determine the compaction effort of first compacting element 110 and second compacting element 120. Many other characteristics and data parameters known to a person of skill in the art go into determining the compaction effort put out by the variable vibratory mechanism 130. The present disclosure is therefore not limited to the fluid mass as being the only factor in determining the compaction effort. Instead, it is one of many factors.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure, and the appended claims.

What is claimed is:

1. A vibratory compactor comprising:
- a frame;
- a first cylindrical drum having a modifiable first compaction effort, wherein the first cylindrical drum is coupled to the frame;
- a second cylindrical drum having a modifiable second compaction effort, wherein the second cylindrical drum is coupled to the frame and disposed behind the first cylindrical drum;
- a fluid reservoir;
- a sensor measuring a first data parameter, wherein the first data parameter is the amount of a fluid in the fluid reservoir; and
- a control system configured to:
  - receive the first data parameter;
  - determine a first target compaction effort for the first cylindrical drum based on the first data parameter;
  - determine a second target compaction effort for the second cylindrical drum based on the first data parameter;
  - modify the first compaction effort to the first target compaction effort; and
  - modify the second compaction effort to the second target compaction effort whereby changes in mass of the vibratory compactor are compensated.

2. The vibratory compactor of claim 1, wherein the control system determines a first target compaction effort for the first cylindrical drum based on the mass of the fluid in the fluid reservoir.

3. The vibratory compactor of claim 2, wherein the control system determines a second target compaction effort for the second cylindrical drum based on the mass of the fluid in the fluid reservoir.

4. The vibratory compactor of claim 1 further comprising a second fluid reservoir and a second sensor measuring a second data parameter, wherein the second data parameter is the amount of a second fluid in the second fluid reservoir.

5. The vibratory compactor of claim 4, wherein the control system is further configured to:
- receive the second data parameter;
- determine a third target compaction effort for the first cylindrical drum based on the second data parameter;
- determine a fourth target compaction effort for the second cylindrical drum based on the second data parameter;
- modify the first compaction effort to the third target compaction effort; and
- modify the second compaction effort to the fourth target compaction effort.

6. The vibratory compactor of claim 5, wherein the control system determines a third target compaction effort for the first cylindrical drum based on the mass of the second fluid in the second fluid reservoir.

7. The vibratory compactor of claim 6, wherein the control system determines a fourth target compaction effort for the second cylindrical drum based on the mass of the second fluid in the second fluid reservoir.

8. The vibratory compactor of claim 5, wherein the control system is further configured to:
- determine a fifth target compaction effort for the first cylindrical drum based on the first data parameter and the second data parameter;
- determine a sixth target compaction effort for the second cylindrical drum based on the first data parameter and the second data parameter;
- modify the first compaction effort to the fifth target compaction effort; and
- modify the second compaction effort to the sixth target compaction effort.

9. A vibratory compactor comprising:
- a first compacting element having a variable vibratory mechanism that sets a modifiable compaction effort;
- a second compacting element;
- a fluid reservoir;
- a first sensor configured to measure a first data parameter associated with the fluid reservoir; and
- a control system configured to:
  - receive the first data parameter;
  - determine a target compaction effort for the first compacting element based on the first data parameter; and
  - modify the variable vibratory mechanism to set the compaction effort at the target compaction effort whereby changes in mass of the vibratory compactor are compensated.

10. The vibratory compactor of claim 9, wherein the control system determines the target compaction effort based on the mass of a fluid in the fluid reservoir.

11. The vibratory compactor of claim 10, wherein the first data parameter is a level of the fluid in the fluid reservoir.

12. The vibratory compactor of claim 9 further comprising:
- a second fluid reservoir; and
- a second sensor configured to measure a second data parameter associated with the second fluid reservoir.

13. The vibratory compactor of claim 12, wherein the control system is further configured to:
- receive the second data parameter;
- determine a second target compaction effort for the first compacting element based on the first data parameter and the second data parameter; and
- modify the variable vibratory mechanism to set the compaction effort at the second target compaction effort.

14. The vibratory compactor of claim 13, wherein the control system determines the second target compaction effort based on the mass of a second fluid in the second fluid reservoir.

15. The vibratory compactor of claim 14, wherein the second compacting element has a second variable vibratory mechanism that sets a modifiable second compaction effort.

16. The vibratory compactor of claim 15, wherein the control system is further configured to:
- determine a third target compaction effort for the second compacting element based on the first data parameter and the second data parameter; and
- modify the second variable vibratory mechanism to set the second compaction effort at the third target compaction effort.

17. A method of vibratory compaction, the method comprising:
- providing a vibratory compactor assembly having:
  - a first cylindrical drum having a modifiable first compaction effort;
  - a second cylindrical drum; and
  - a fluid reservoir;
- rotating a first cylindrical drum;

rotating a second cylindrical drum;

determining a mass of a fluid in the fluid reservoir;

determining a target compaction effort for the first cylindrical drum based on the mass; and modifying the first compaction effort to the target compaction effort whereby changes in mass of the vibratory compactor are compensated.

18. The method of vibratory compaction of claim 17, wherein the second cylindrical drum has a modifiable second compaction effort, and wherein the method further comprises:

determining a second target compaction effort for the second cylindrical drum based on the mass; and modifying the second compaction effort to the second target compaction effort.

19. The method of vibratory compaction of claim 17, wherein the vibratory compactor assembly further includes a second fluid tank, and wherein the method further comprises:

determining a second mass of a second fluid in the second fluid reservoir;

determining a third target compaction effort for the first cylindrical drum based on the mass and the second mass; and modifying the first compaction effort to the third target compaction effort.

20. The method of vibratory compaction of claim 19, wherein the second cylindrical drum has a modifiable second compaction effort, and wherein the method further comprises:

determining a fourth target compaction effort for the second cylindrical drum based on the mass and the second mass; and modifying the second compaction effort to the fourth target compaction effort.

* * * * *